United States Patent [19]

Ruff

[11] 4,213,317

[45] Jul. 22, 1980

[54] BLANK FILLER PLATE FOR LOCK EDGE CUT-OUT

[75] Inventor: Robert O. Ruff, Cincinnati, Ohio

[73] Assignee: American Standard Inc., New York, N.Y.

[21] Appl. No.: 13,348

[22] Filed: Feb. 21, 1979

[51] Int. Cl.[2] ..... E05B 9/08; E05B 63/00

[52] U.S. Cl. ..... 70/450; 70/461

[58] Field of Search ..... 70/450, 451, 461, 447, 70/448

[56] References Cited

U.S. PATENT DOCUMENTS

| | | | |
|---|---|---|---|
| 1,238,924 | 9/1917 | Kennedy | 70/461 |
| 3,479,851 | 11/1969 | Davidson | 70/450 |
| 4,080,813 | 3/1978 | McKann | 70/450 |

*Primary Examiner*—Robert L. Wolfe

*Attorney, Agent, or Firm*—James J. Salerno, Jr.; Robert G. Crooks

[57] ABSTRACT

A blank filler plate for the lock edge cut-out in a steel door is disclosed. The blank filler plate which does not utilize visible fastening means is removably mounted in the lock edge cut-out. The blank filler plate is provided with zones of weakening for adjusting the size of the blank filler plate after the door hardware has been installed.

8 Claims, 9 Drawing Figures

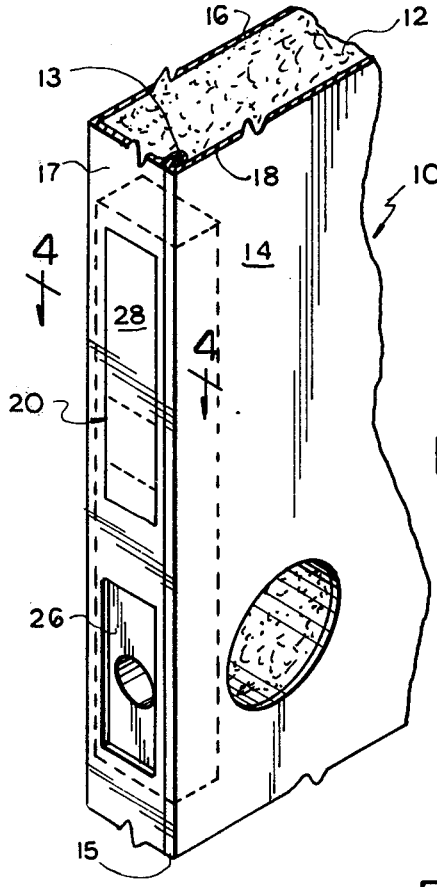
FIG. 3
FIG. 4
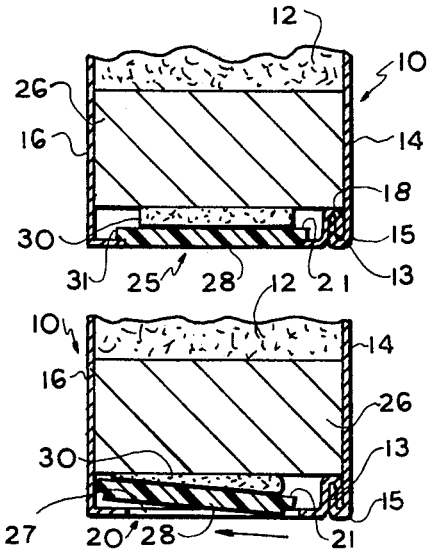
FIG. 5B
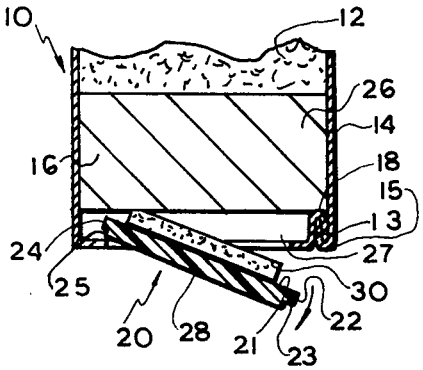
FIG. 5A

FIG. 6
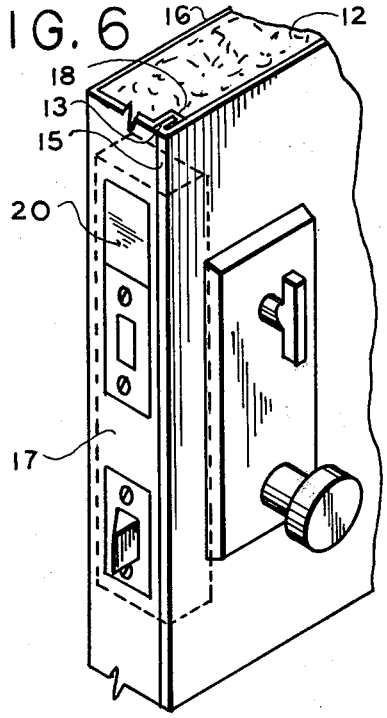
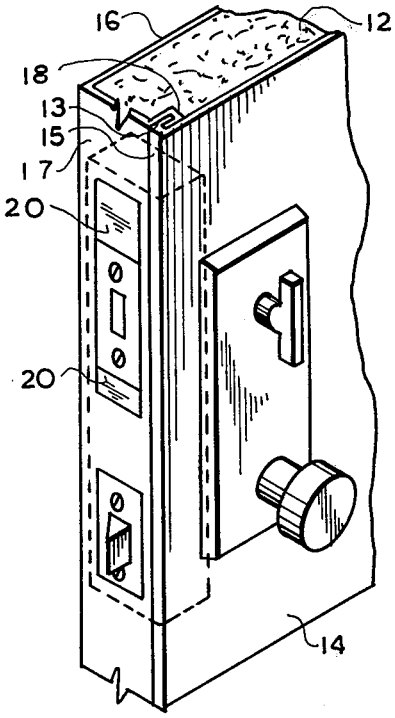
FIG. 7
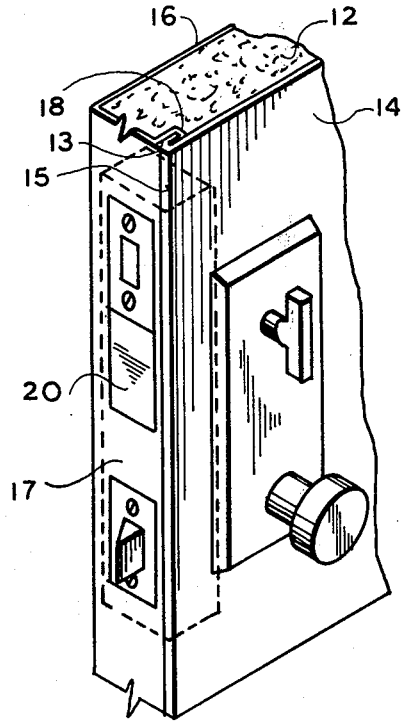
FIG. 8

BLANK FILLER PLATE FOR LOCK EDGE CUT-OUT

BACKGROUND OF THE INVENTION

This invention relates to steel door construction and more particularly to a blank filler plate for the lock edge cut-out in a steel door.

In steel door construction, the various openings are precut in steel sheets prior to forming the sheets and assembly of the door. The cut-outs for mounting the hinges and the standard lock edge cut-out are precut so that a standard lock assembly and hinges can be installed without further preparation of the door. When a customer desires a different type of lock assembly other than a standard lock assembly, a new lock edge cut-out will be required. After the door is assembled, additional openings are difficult to prepare and can only be accurately cut by using special tools. Any cross bore that may be required need not be precut since the cross bore for a dead bolt assembly or the like may vary with the type of lock to be used. The center line for any cross bore may vary and can be accurately cut by the door installer or distributer. To provide the various lock designs, a blank filler plate is utilized and is mounted in place by screws in the lock edge cut-out; however, screw mounted blank filler plates require additional steps to mount and do not give a neat appearance to the door. Such an assembly is disclosed in U.S. Pat. No. 4,080,813. Other lock designs are disclosed in U.S. Pat. No. 3,479,851 and U.S. Pat. No. 3,426,418.

BRIEF DESCRIPTION OF THE INVENTION

It is an object of the invention to provide a blank filler plate having means for removably mounting the plate in the lock edge cut-out of a steel door.

It is another object of the invention to provide a blank filler plate which is easy to install and remove from the lock edge cut-out of a door, in which only the outer perimeter thereof is visible, and no visible fasteners are required to hold the blank filler plate in position.

The invention generally contemplates the use of a blank filler plate which is releasably mounted in a lock edge cut-out of a steel door. The blank filler plate includes latch means integrally formed along opposed vertical edges of the plate and resilient means mounted on the inner surface of the filler plate for maintaining the plate in position in the lock edge cut-out so that the outer surface of the plate lies in the plane of the outer surface of the vertical edge of the door. The blank filler plate may also include zones of weakening formed along the inner surface thereof and extend normal to its vertical edges so that when a dead bolt or other variations of a standard lock is mounted in the lock edge cut-out, the size of the blank filler plate can be adjusted.

BRIEF DESCRIPTION OF THE DRAWINGS

The several features and advantages of the invention will be more apparent to those skilled in the art from the following description of the drawings which form a part of this specification.

FIG. 3 is an enlarged fragmentary isometric view of the lock section of the door as indicated in the circle of FIG. 1 to clearly illustrate the blank filler plate mounted in the lock edge cut-out of the steel door;

FIG. 4 is a sectional view taken along the lines 4—4 of FIG. 3;

FIGS. 5A and 5B illustrate the sequence of steps for the removal of the blank filler plate shown in FIG. 3;

FIGS. 6 to 8 are enlarged fragmentary isometric views of various designs of door hardware in which portions of the blank filler plate are utilized.

DESCRIPTION OF THE PREFERRED EMBODIMENT

Figure 1:
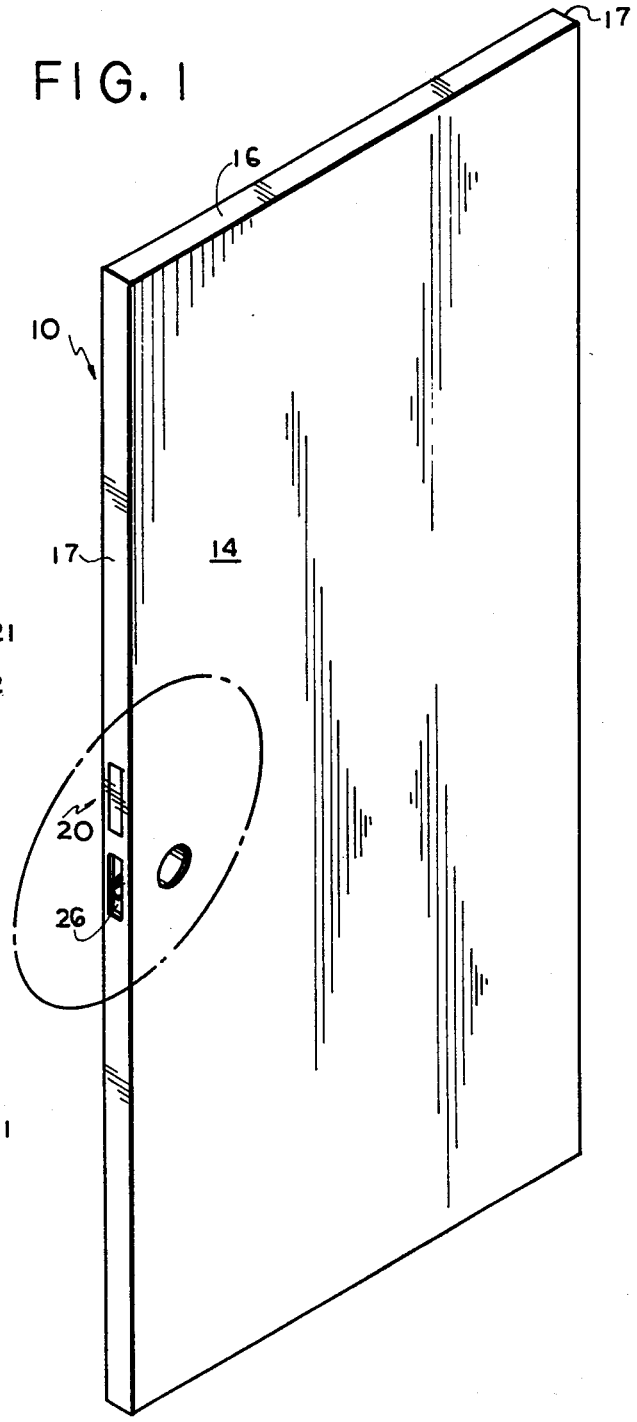
FIG. 1 is an isometric view of a steel door with the standard preparation for the door knob and lock bolt cut-outs and the blank filler plate mounted in the edge cut-out.
Figure 2:
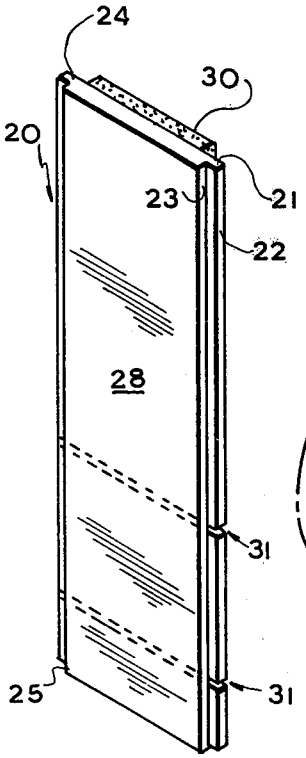
FIG. 2 is an isometric view of the blank filler plate shown mounted in position in FIG. 1.

The invention is best illustrated in FIGS. 1 through 5B. In FIG. 1, steel door 10 illustrates blank filler plate 20 of the present invention, mounted in the lock edge cut-out 22 of steel door 10 so that the outer surface of the blank filler plate is continuous with the outer vertical edge surface of the door. Steel door 10, as illustrated, is of the flush type and is made generally in accordance with the steel door assembly disclosed in U.S. Pat. No. 3,333,385. The door comprises opposed panels 14 and 16 formed of sheet material. Panel 14 includes side flanges 15—15 having inturned lips 13. Panel 16 includes side flanges 17—17 which form the vertical side edges of the assembled door 10. Flange 17 is bent in the form of a "U"to form a groove 18 adapted to receive mating lips 13 of panel 14 so that panels 14 and 16 are latched or locked together by the mating of the lips 13 with the grooves 18 and is most clearly shown in FIG. 4.

Door 10 includes a filler core 12 of the honeycomb design and may be, for example, filled with a foamed plastic material such as foamed polyurethane to provide sound deadening and insulating means and also to reinforce the door when fully assembled. A wooden lock reinforcement 26 is positioned against the inner face of the lock vertical flange 17. Wood lock reinforcement 26 extends along vertical flange 17 approximately the area delineated by the circle in FIG. 1 and serves as backing member for blank filler plate 20 and also provides means for mounting the hardware in door 10.

Blank filler plate 20 is preferably made of plastic such as molded vinyl or the like. Opposed parallel lips or flanges 22, 24 are formed along the opposed vertical edges of blank filler plate 20. Steps 23, 25 are formed having a depth equal to the gauge of the sheet steel used to form panels 14 and 16 so that the outer face 28 of blank filler plate 20 lies in the same plane of the outer face of vertical flange 17. Thus, when blank filler plate 20 is mounted in the lock edge cut-out 27 of vertical flange 17 only an embossed line is visible since the outer perimeter of the blank filler plate 20 is visible and simulates an embossed section of the door. There are no visible fastening means such as screws for holding blank filler plate 20 in position.

A resilient member 30 is mounted on the inner face 21 of blank filler plate 20 which biases against the wood filler stile 26 mounted along the inner face of vertical edge 17. When blank filler plate 20 is mounted in lock edge cut-out 27 resilient member 30 urges blank filler plate 20 outwardly so that lips 22 and 24 are latched against the inner vertical edges 28, 29 of lock edge cut-out 27 to hold blank filler plate 20 in place. Resilient material 30 is preferably made of a cellular compressible, resilient and flexible material so as to provide the necessary force required to hold blank filler plate 20 in position in the lock edge cut-out 27. Resilient member or material 30 is mounted on the inner surface 21 of blank filler plate 20 by a suitable adhesive 33. Resilient material 30 may be either synthetic or foam rubber and may be either an open or closed cell foam. Suitable synthetic foam materials may be either an open or closed cell polyurethane foam, or polyvinyl open cell foam or a closed natural rubber foam. Also formed on surface 21 of blank filler plate 20 are transversely spaced grooves which form weakening zones 31 and are illustrated in dotted lines in FIG. 2. These zones of weakening permit the blank filler plate to be broken in a clean straight line to provide properly sized section or sections which are used to fill the remaining opening in lock edge cut-out 27 as illustrated in FIGS. 6 through 8.

Referring to FIGS. 4, 5A and 5B, a sequence of steps is illustrated which indicate the method for removing blank filler plate 20 from edge cut-out 27. Obviously, the reverse sequence of steps shown in FIGS. 5B, 5A and 4 are used to mount blank filler plate 20 in lock edge cut-out 27. To remove blank filler plate 20, digital pressure is applied to its outer face to urge blank filler plate 20 toward panel 16. Step 25 of lip 24 will be forced inwardly so that outer face of blank filler plate 20 will slide inside vertical flange 17. Digital pressure is then removed and the resilient material 30 will return to its relaxed or uncompressed form so as to force step 23 of lip 22 radially outwardly as shown in FIG. 5B. Blank filler plate 20 is then grasped and removed from the lock edge cut-out 27. A door knob and lock assembly such as is illustrated in FIGS. 6 through 88 may then be installed in the conventional manner after the appropriate cross bore opening is made in door 10 to fit the dead bolt assembly in lock edge cut-out 27. The standard door knob and door latch is mounted in the openings shown in FIG. 1. Blank filler plate 20 is then severed along one or more of the weakening zones to provide properly sized blank filler plate section or sections which are then mounted in the respective opening of lock edge cut-out 27 as illustrated in FIGS. 6 through 8.

What is claimed:

1. A blank filler plate adapted to be mounted in a lock edge cut-out of a steel door, the blank filler plate comprising:

a generally elongated rectangular member having latch means integrally formed along opposed vertical edges thereof and adapted to releasably couple with the respective edges of the lock edge cut-out; and resilient compressible means mounted on the inner surface of said plate so that said resilient compressible means urges said blank filler plate member outwardly of said lock edge cut-out whereby said latch means biases against the respective edges of said lock edge cut-out to hold said plate in position.

2. The blank filler plate of claim 1 wherein said latch means includes opposed flanges formed along the opposed vertical edges of said blank filler plate, said flanges being recessed so as to form a step between said flange and the outer surface of said blank filler plate, the height of which, is substantially equal to the gauge of said steel door whereby the outer surface of said plate lies in the plane of the outer surface of the lock edge of said door.

3. The blank filler plate of claim 1 wherein said resilient compressible means is made of a synthetic cellular plastic material and is adhesively bonded to the inner surface of said blank filler plate.

4. The blank filler plate of claim 1 wherein said plate further includes a weakening zone formed transversely of said opposed surface of said plate.

5. The blank filler plate of claim 4 wherein said zone of weakening is at least two.

6. The blank filler plate of claim 4 wherein said zone of weakening is a groove.

7. The blank filler plate of claim 1 wherein said plate is formed of a thermoplastic material.

8. In a steel door assembly of the type formed of a pair of opposed sheet metal panels and a core mounted therebetween, said opposed panels including opposed vertical side flanges integrally formed therewith, said flanges having latch means for coupling said panels in fixed position and one of said vertical flanges having a lock edge cut-out and a blank filler plate mounted therein, said blank filler plate comprising:

a generally elongated rectangular member having latch means integrally formed along opposed vertical edges thereof and adapted to releasably couple with the respective edges of the lock edge cut-out; and resilient compressible means mounted on the inner surface of said plate so that said resilient compressible means urges said blank filler plate member outwardly of said lock edge cut-out whereby said latch means biases against the respective edges of said lock edge cut-out to hold said plate in position.

* * * * *

REEXAMINATION CERTIFICATE (424th)

United States Patent [19] [11] B1 4,213,317

Ruff [45] Certificate Issued Nov. 19, 1985

[54] BLANK FILLER PLATE FOR LOCK EDGE CUT-OUT

[75] Inventor: Robert O. Ruff, Cincinnati, Ohio

[73] Assignee: American Standard Inc., New York, N.Y.

Reexamination Request:
No. 90/000,503, Feb. 14, 1984

Reexamination Certificate for:

| | |
|---|---|
| Patent No.: | **4,213,317** |
| Issued: | **Jul. 22, 1980** |
| Appl. No.: | **13,348** |
| Filed: | **Feb. 21, 1979** |

[51] Int. Cl.[4] ..... E05B 9/08; E05B 63/00
[52] U.S. Cl. ..... 70/450; 70/461
[58] Field of Search ..... 70/447, 448, 450, 451, 70/461; 292/340, 341.11, 341.12, 341.13; 16/86 A

[56] References Cited

U.S. PATENT DOCUMENTS

| | | | |
|---|---|---|---|
| 1,004,716 | 10/1911 | Voight | 292/341.14 |
| 1,005,841 | 10/1911 | Hurd . | |
| 1,037,593 | 9/1912 | Cole | 16/86 A |
| 1,238,924 | 9/1917 | Kennedy . | |
| 2,159,477 | 5/1939 | Friedman . | |
| 2,190,518 | 2/1940 | Joyce | 292/341.15 |
| 2,588,230 | 3/1952 | George | 70/363 |
| 2,817,274 | 12/1957 | Benoit . | |
| 3,479,851 | 11/1969 | Davidson et al. . | |
| 3,580,629 | 5/1971 | Heim . | |
| 3,636,745 | 1/1972 | Green | 292/341.14 |
| 3,647,057 | 3/1972 | Ashmead et al. . | |
| 4,080,813 | 3/1978 | McKann . | |

OTHER PUBLICATIONS

General Products Company, Inc. Instruction Sheet for the Benchmark Filler Plate.
Shelter Magazine Article, p. 27, Product Description for Universal Hardware Adapter System Manufactured by Precision Building Products.
Steelcraft Bulletin No. B-5-75 entitled "Plastic Edge Filler Plate for Gov't. 160-161" published by Steelcraft Division, American Standard Inc.

*Primary Examiner*—Robert L. Wolfe

[57] ABSTRACT

A blank filler plate for the lock edge cut-out in a steel door is disclosed. The blank filler plate which does not utilize visible fastening means is removably mounted in the lock edge cut-out. The blank filler plate is provided with zones of weakening for adjusting the size of the blank filler plate after the door hardware has been installed.

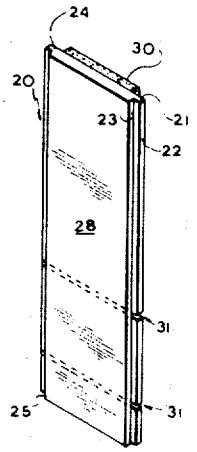

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–8 are cancelled.

New claims 9–16 are added and determined to be patentable.

*9. A blank filler plate which is releasably mountable in a lock edge cut-out of a steel door without fastening means visible from the exterior thereof and without the use of hand tools, comprising*

*a generally elongated rectangular member having a forward face exposed to view when the blank filler plate is operatively mounted in the lock edge cut-out of a door, a rearward face, and a pair of opposed parallel flanges formed along the opposed vertical edges of the filler plate adapted to releasably couple with the respective edges of the lock edge cut-out, and*

*resilient compressible means mounted on the rearward face of the plate, the uncompressed depth of said compressible means measured perpendicular to said rearward face being substantially less than the long dimension of said plate, said means (a) permitting the plate and compressible means to be simultaneously manually positioned through the cut-out at an angle to the plane thereof from the exterior of the door and pressed inwardly and slid sideways in the cut-out to release or engage the flanges of the filler plate relative to the respective edges of the cut-out such that the filler plate may be selectively removed or inserted from the cut-out from outside of the door without the use of hand tools, and (b) urging the filler plate outwardly of the cut-out when the plate is operatively located in the cut-out with its forward face parallel to the plane of the cut-out such that the flanges are biased against the respective rear marginal portions of the door edge surrounding the respective vertical edges of the cut-out to hold the filler plate in place in the cut-out without externally visible fastening means,*

*said flanges being offset rearwardly from said forward face a distance substantially equal to the gauge of the sheet metal used to form the door edge such that when operatively located in place in the cut-out the forward face of the filler plate is substantially flush with the outer surface of the door edge and the flanges are hidden from view.*

*10. The blank filler plate of claim 9 having a weakened zone disposed transversely of said long dimension to facilitate separating said plate into plural sections at said weakened zone, said resilient means including segments respectively mounted on the rearward face of said plural sections to enable any selected one of said plate sections to be individually urged outwardly of said cut-out by its associated resilient segment means when said selected individual plate section is operatively located in said cut-out at any vertical position thereof.*

*11. In a steel door assembly, the combination comprising*

*a door comprising a pair of opposed sheet metal panels, a pair of vertical side edges, and a lock reinforcement member therebetween, one of said vertical side edges having a lock edge cut-out therein defining with said lock reinforcement member a relatively shallow cavity interiorly of said door,*

*a blank filler plate releasably mountable in said lock edge cut-out comprising a generally elongated rectangular member having a forward face exposed to view, a rearward face, and a pair of opposed parallel vertical flanges formed along opposed vertical edges of the filler plate which are releasably coupleable with the respective vertical edges of the lock edge cut-out, and*

*resilient compressible means mounted on the rearward face of the plate, the uncompressed depth of said compressible means measured perpendicular to said rearward face being greater than the depth of said cavity, both the depth of said cavity and the depth of said compressible means being substantially less than the longest dimension of said plate, said resilient compressible means urging the filler plate outwardly of the cut-out when said filler plate is operatively located therein such that the flanges are biased against the respective rear vertical marginal portions of the door edge surrounding the vertical edges of the cut-out, thereby holding the filler plate operatively in place in the cut-out without visible fastening means, and further permitting the filler plate to be manually pressed inwardly into the cavity from the exterior of the door and slid sideways in said cavity to release the flanges of the filler plate from the respective edges of the cut-out such that the filler plate may be selectively inserted in or removed from the cut-out from outside of the door without the use of hand tools,*

*said flanges being offset rearwardly of said forward face a distance substantially equal to the gauge of the sheet metal used to form the vertical side edges of the door such that when operatively located in place in the cut-out the forward face of the filler plate is substantially flush with the outer surface of the door edge and said flanges are hidden from view.*

*12. The steel door assembly of claim 11 wherein said blank filler plate has a weakened zone disposed transversely of said long dimension to facilitate separating said plate into plural sections at said weakened zone, said resilient means including segments respectively mounted on the rearward face of said plural sections to enable any selected one of said plate sections to be individually urged outwardly of said cut-out by its associated resilient segment means when said selected individual plate section is operatively located in said cut-out at any vertical position thereof.*

*13. A blank filler plate which is releasably mounted in a lock edge cut-out of a steel door without fastening means visible from the exterior thereof and without the use of hand tools, comprising*

*a generally elongated rectangular member having a forward face exposed to view when the blank filler plate is operatively mounted in the lock edge cut-out of a door, a rearward face, and a pair of opposed parallel flanges formed along the opposed vertical edges of the filler plate adapted to releasably couple with the respective edges of the lock edge cut-out, and*

*resilient compressible means mounted on the rearward face of the plate, the uncompressed depth of said*

*compressible means measured perpendicular to said rearward face being substantially less than the long dimension of said plate, said means (a) permitting the plate to be manually positioned through the cut-out at an angle to the plane thereof from the exterior of the door and pressed inwardly and slid sideways in the cut-out to release or engage the flanges of the filler plate relative to the respective edges of the cut-out such that the filler plate may be selectively removed or inserted from the cut-out from outside of the door without the use of hand tools, and (b) urging the filler plate outwardly of the cut-out when the plate is operatively located in the cut-out with its forward face parallel to the plane of the cut-out such that the flanges are biased against the respective rear marginal portions of the door edge surrounding the respective vertical edges of the cut-out to hold the filler plate in place in the cut-out without externally visible fastening means,*

*said flanges being offset rearwardly from said forward face a distance such that when operatively located in place in the cut-out the forward face of the filler plate is approximately flush with the outer surface of the door edge and the flanges are substantially hidden from view.*

*14. In a steel door assembly, the combination comprising*

*a door comprising a pair of opposed sheet metal panels, a pair of vertical side edges, and a lock reinforcement member therebetween, one of said vertical side edges having a lock edge cut-out therein defining with said lock reinforcement member a relatively shallow cavity interiorly of said door,*

*a blank filler plate releasably mountable in said lock edge cut-out comprising a generally elongated rectangular member having a forward face exposed to view, a rearward face, and a pair of opposed parallel vertical flanges formed on the vertical edges of the plate which are releasably coupleable with the respective vertical edges of the lock edge cut-out, and*

*resilient compressible means mounted on said rearward face of said filler plate, the uncompressed depth of said compressible means measured perpendicular to said rearward face being greater than the depth of said cavity, both the depth of said cavity and the depth of said compressible means being substantially less than the longest dimension of said plate, said resilient compressible means urging the filler plate outwardly of the cut-out when said filler plate is operatively located therein, with said resilient compressible means sandwiched between said plate and reinforcing member and in compressed contacting relationship therewith, such that the flanges are biased against the respective rear vertical marginal portions of the door edge surrounding the vertical edges of cut-out, thereby holding the filler plate operatively in place in the cut-out without visible fastening means, and further permitting the filler plate to be manually pressed inwardly into the cavity from the exterior of the door and slid sideways in said cavity to release the flanges of the filler plate from the respective edges of the cut-out such that the filler plate may be selectively inserted in or removed from the cut-out from outside of the door without the use of hand tools,*

*said flanges being offset rearwardly of said forward face a distance such that when operatively located in place in the cut-out the forward face of the filler plate is approximately flush with the outer surface of the door edge and said flanges are substantially hidden from view.*

*15. A blank filler plate which is mounted in a lock edge cut-out of a steel door without fastening means visible from the exterior thereof and without the use of hand tools, comprising*

*a generally elongated rectangular member having a forward face exposed to view when the blank filler plate is operatively mounted in the lock edge cut-out of a door, a rearward face, and a pair of opposed parallel flanges along opposed vertical edges of the filler plate adapted to releasably couple with the respective edges of the lock edge cut-out, and*

*resilient compressible means mounted on the rearward face of the plate, the uncompressed depth of said compressible means measured perpendicular to said rearward face being substantially less than the longest dimension of said plate, said means (a) permitting the plate to be manually positioned through the cut-out at an angle to the plane thereof from the exterior of the door and pressed inwardly and slid sideways in the cut-out to engage the flanges of the filler plate relative to the respective edges of the cut-out such that the filler plate may be inserted into the cut-out from outside of the door without the use of hand tools, and (b) urging the filler plate outwardly of the cut-out when the plate is operatively located in the cut-out with its forward face parallel to the plane of the cut-out such that the flanges are biased against the respective rear marginal portions of the door edge surrounding the vertical edges of the cut-out to hold the filler plate in place in the cut-out without externally visible fastening means.*

*16. In a steel door assembly, the combination comprising*

*a door comprising a pair of opposed sheet metal panels, a pair of vertical side edges, and a lock reinforcement member therebetween, one of said vertical side edges having a lock edge cut-out therein defining with said lock reinforcement member a relatively shallow cavity interiorly of said door,*

*a blank filler plate mountable in said lock edge cut-out comprising a generally elongated rectangular member having a forward face exposed to view, a rearward face, and a pair of opposed parallel vertical flanges formed on the edges of the plate which are releasably coupleable with the respective vertical edges of the lock edge cut-out, and*

*resilient compressible means mounted on said rearward face of said filler plate, the uncompressed depth of said compressible means measured perpendicular to said rearward face being greater than the depth of said cavity, both the depth of said cavity and the depth of said compressible means being substantially less than the longest dimension of said plate, said resilient compressible means urging the filler plate outwardly of the cut-out when said filler plate is operatively located therein, with said resilient compressible means sandwiched between said plate and reinforcing member and in compressed contacting relationship therewith, such that the flanges are biased against the respective rear vertical marginal portions of the door edge surrounding the vertical edges of the cut-out, thereby holding the filler plate operatively in place in the cut-out without visible fastening means, and further permitting the filler plate to be manually pressed inwardly into the cavity from the exterior of the door and slid sideways in said cavity to release the flanges of the filler plate from the respective edges of the cut-out such that the filler plate may be inserted in the cut-out from outside of the door without the use of hand tools.*

* * * * *